US008313093B2

(12) United States Patent
Losi, Jr. et al.

(10) Patent No.: US 8,313,093 B2
(45) **Date of Patent: *Nov. 20, 2012**

(54) PORTABLE VISE

(75) Inventors: Raymond H. Losi, Jr., Westlake Village, CA (US); David W. McManama, Temecula, CA (US)

(73) Assignee: Tri-Vise, LLC, Westlake Village, CA (US)

( * ) Notice: Subject to any disclaimer, the term of this patent is extended or adjusted under 35 U.S.C. 154(b) by 272 days.

This patent is subject to a terminal disclaimer.

(21) Appl. No.: 12/438,002

(22) PCT Filed: Mar. 12, 2008

(86) PCT No.: PCT/US2008/056644

§ 371 (c)(1),
(2), (4) Date: May 5, 2010

(87) PCT Pub. No.: WO2008/112752

PCT Pub. Date: Sep. 18, 2008

(65) Prior Publication Data

US 2010/0230881 A1 Sep. 16, 2010

Related U.S. Application Data

(60) Provisional application No. 60/894,429, filed on Mar. 12, 2007.

(51) Int. Cl.
*B25B 11/00* (2006.01)

(52) U.S. Cl. ..... 269/10; 269/9; 269/3; 269/6; 269/287

(58) Field of Classification Search ..... 269/9, 3, 269/6, 287, 100, 900, 95, 13, 16; D10/109, D10/110, 113

See application file for complete search history.

(56) References Cited

U.S. PATENT DOCUMENTS

| | | | | |
|---|---|---|---|---|
| 1,773,128 | A | 8/1930 | Barrus | |
| D327,658 | S | 7/1992 | Kulp et al. | |
| D340,994 | S | 11/1993 | McIntyre | |
| 5,794,923 | A | 8/1998 | Bartlett | |
| 6,523,818 | B1 | 2/2003 | Le Vert et al. | |
| D471,123 | S | 3/2003 | Brown | |
| 7,722,019 | B2 * | 5/2010 | Losi et al. | 269/9 |
| 2009/0236784 | A1 * | 9/2009 | Losi et al. | 269/9 |
| 2010/0230881 | A1 * | 9/2010 | Losi et al. | 269/10 |

* cited by examiner

*Primary Examiner* — Lee D Wilson
(74) *Attorney, Agent, or Firm* — Inskeep IP Group, Inc.

(57) ABSTRACT

A portable vise, particularly for use in supporting elongated member, provides a convenient design for safely cutting, drilling, welding, and painting. An elongated member is inserted through an aperture of a vise body. The vise rests upon the ground or other work surface such that one end of the elongated member is supported over the work surface while the other end of the elongated member rests upon the work surface.

21 Claims, 5 Drawing Sheets

PORTABLE VISE

RELATED APPLICATIONS

This application claims priority to International Patent Application No. PCT/US2008/056644, International Filing Date Mar. 12, 2008, entitled Portable Vise, and to U.S. Provisional Application Ser. No. 60/894,429, filed Mar. 12, 2007, entitled Portable Vise, both of which are hereby incorporated by reference.

BACKGROUND OF THE INVENTION

While working with elongated materials or workpieces such as, lumber, plastic or metal pipe, conduit, unistrut, rebar, or dowels, it is often desirable to elevate or otherwise support and hold secure such materials above a work surface. Elevating the material allows for the unimpeded movement of painting utensils, saws, drills, welders, and other tools around the circumference of the material. For example, when cutting lumber with a circular hand saw, the circular saw blade will protrude through the backside of the lumber as the cut is being made. If the lumber is not elevated while sawing, the saw blade may bind or penetrate the surface upon which the lumber is situated. This may result in unwanted damage to the surface and potentially hazardous working conditions.

To avoid these problems, workers may support the workpiece with their own body, e.g. by placing their knee under the material or supporting the material in their hand, or they may use a make-shift support or surface, e.g. steps, tables, saw horses, or cement blocks. As illustrated in FIG. 6, the prior art method of holding or self-supporting the elongated material fails to provide a stable, secure support and poses a high degree of risk of personal injury. Make-shift supports may not be intended to support the forces exerted by such activities and are often unavailable, cumbersome to move and impractical for utilities requiring portability. What is needed in the field is a stable, portable support that is capable of elevating and holding an elongated material securely in place.

SUMMARY OF THE INVENTION

It is the object of the present invention to address the aforementioned problems by providing a portable vise for securing, elevating and supporting end portions of elongated workpieces. An end portion of an elongated workpiece is inserted through an aperture in the vise body. The vise body and elongated workpiece are positioned such that one end of the elongated workpiece and one outside edge of the vise are situated upon a work surface and an end portion, or the working end, of the work piece is supported above the work surface.

DETAILED DESCRIPTION OF THE INVENTION

For the sake of clarity, certain embodiments of the present invention are presented by reference to the figures. Where possible, like components present in different figures are referenced with the same number.

Figure 3:
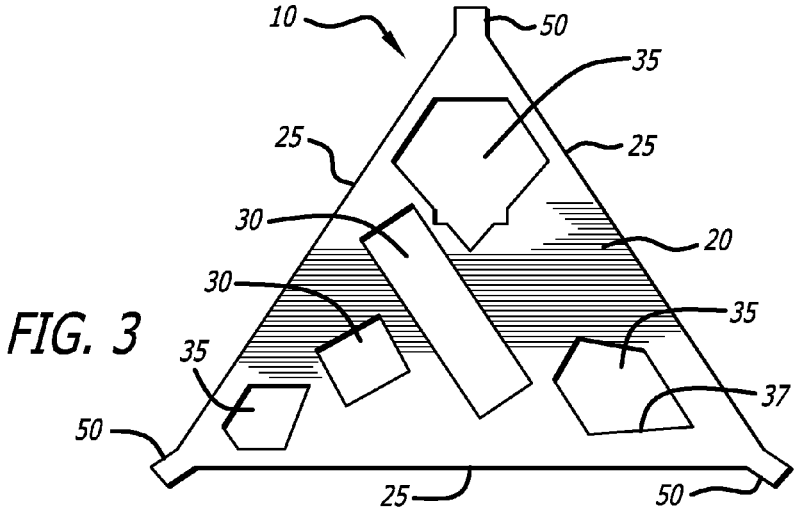
FIG. 3 is a plan view of a preferred embodiment of a triangular device of the present invention.
Figure 4:
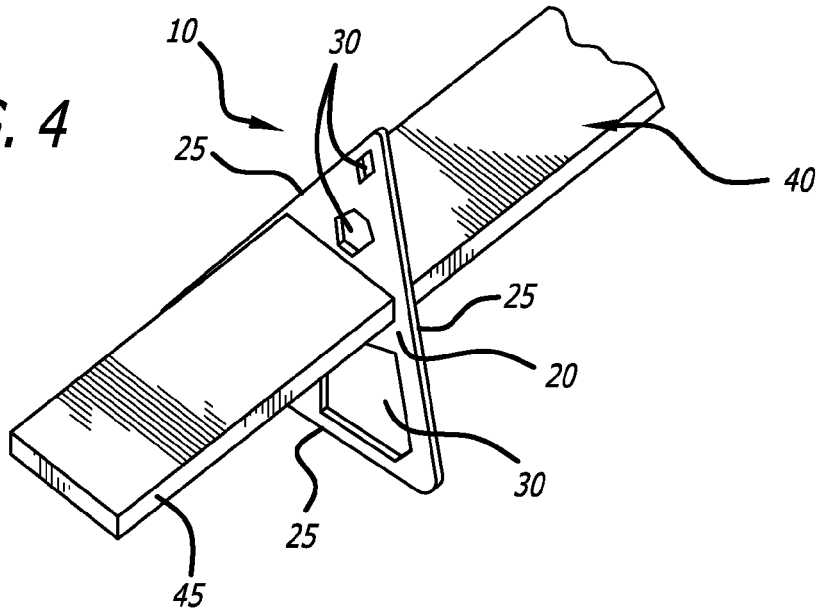
FIG. 4 is a perspective view of a preferred embodiment of a device of the present invention being used to support a workpiece.
Figure 7:
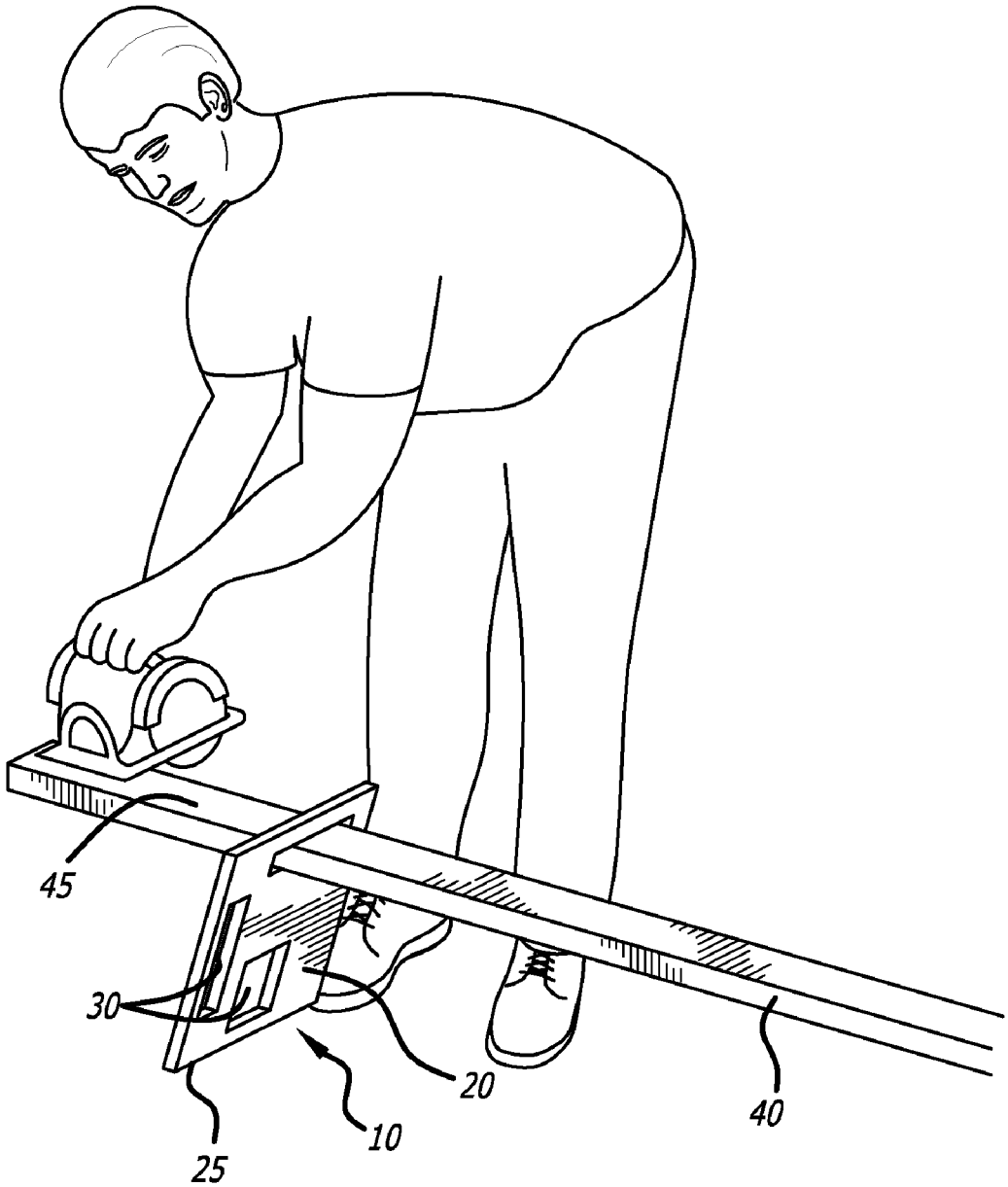
FIG. 7 is a perspective view of a preferred embodiment of a device of the present invention being used to support a workpiece.
Figure 8:
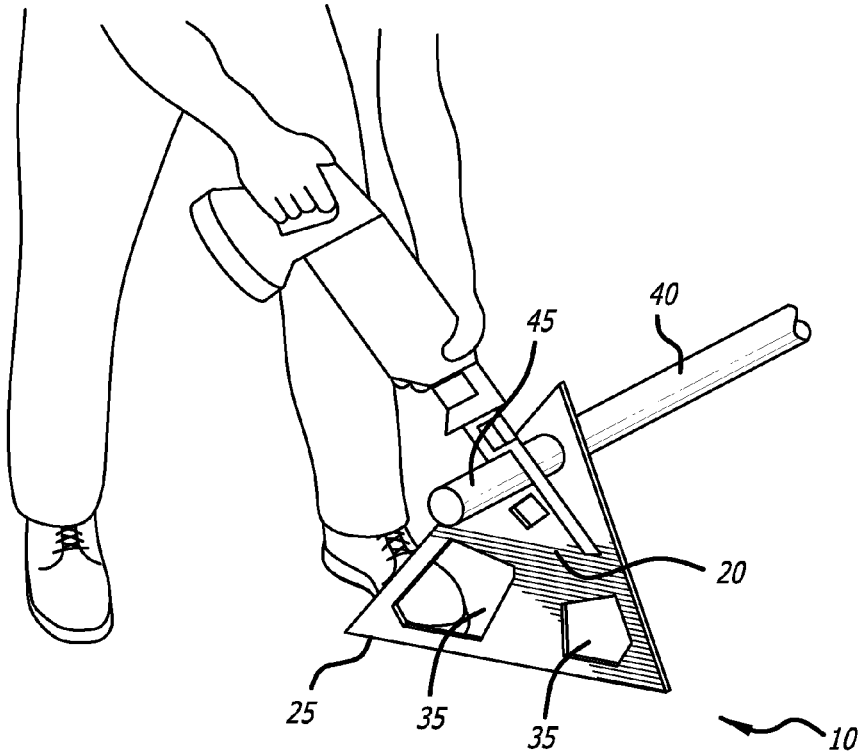
FIG. 8 is a perspective view of a preferred embodiment of a device of the present invention being used to support a workpiece; and, FIG. 9 is a plan view of a preferred embodiment of a triangular device of the present invention.

The present invention provides a portable vise for retaining and securing elongated workpieces or materials, such as a wood or metal beam, pipe, conduit, rebar, unistrut, and dowel. With reference to FIGS. 1-5 and 7-9, portable vise 10 includes body 20 with a plurality of apertures 30 and/or irregular apertures 35. As best illustrated in FIGS. 4, 7, and 8, in operation, an end portion 45 of an elongated workpiece 40 is positioned through an aperture formed in body 20. An external edge 25 of the body 20 is rested upon the ground or other work surface such that the upper-most end of the body 20 is pointing or tilting away from the end portion 45 of the workpiece 40.

In so tilting the body 20, the counter forces exerted upon workpiece 40 by upper and lower inside surfaces 37 of aperture 30 or irregular aperture 35 serve to wedge and secure workpiece 40 such that workpiece 40 will not spin or otherwise move within the aperture. Stated differently, tilting the body 20 relative to the work surface employs an upward force on the bottom of workpiece 40 by an inside surface 37 of the aperture and a downward force on the topside of workpiece 40 by a second inside surface 37 defining the aperture. One skilled in the art will realize that this wedging effect will occur regardless of which way the body 20 is tilted. However, tilting the top of the body 20 away from the end portion 45 of the workpiece 40 better clears the space above the end portion 45 of the workpiece 40.

To generate the maximal force for securing the working piece, a user may select an appropriately shaped aperture that is furthest from the edge 25 of the vise that is resting upon the work surface. The result is that one end of workpiece 40, the end opposite to where the user will be working, rests upon the ground, floor or other work surface. The end portion 45 of the workpiece 40 is supported above the work surface and held securely by vise 10. In this respect, the user can quickly and easily brace an elongated workpiece 40 in place for a variety of purposes, including cutting, drilling, welding or painting the member. As seen in FIGS. 4 and 7, when viewed from the side, the vise 10 and supported workpiece 40 form an X.

The body 20 may be constructed in a plate-like form, i.e., comprising two faces opposite one another and at least one outside edge. The faces need not be but are preferably planar to reduce manufacturing and shipping costs. The body 20 has a height and width that may be significantly greater than its depth or thickness of the edge. For example the thickness of the body 20 may measure between 2 to 6% of the length of one edge of the body 20.

Figure 1:
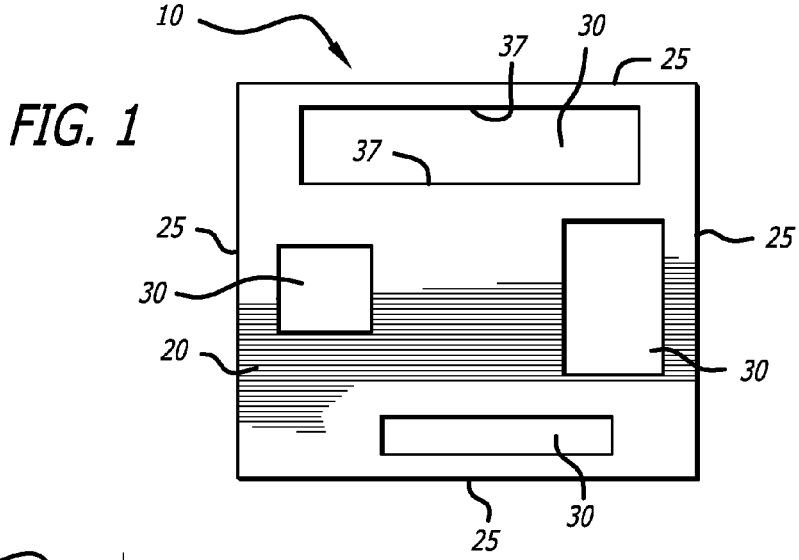
FIG. 1 is a plan view of a preferred embodiment of a rectangular device of the present invention.

Referring to FIGS. 1 and 7, there is shown an embodiment of the present invention having a body 20 that is rectangular or square. A square body 20 maximizes surface area through which apertures may be formed. One example of a device 10 that provides suitable results includes a square body 20, approximately 12 inches in height by 12 inches in width by 0.5 inches in thickness.

Alternatively, as shown in FIGS. 2-5 and 8-9, the body 20 may be triangular. Though a triangular body does not have the surface area for apertures that a square body 20 does, a triangular body 20 is advantageous because the outside edge 25 resting on the work surface is necessarily horizontally the widest portion of the body 20. Hence, stability is maximized by a triangular body 20. Another example of a device 10 that provides suitable results has a triangular body 20 having equilateral edges measuring approximately 16 inches and have a thickness of approximately 0.5 inches.

Figure 5:
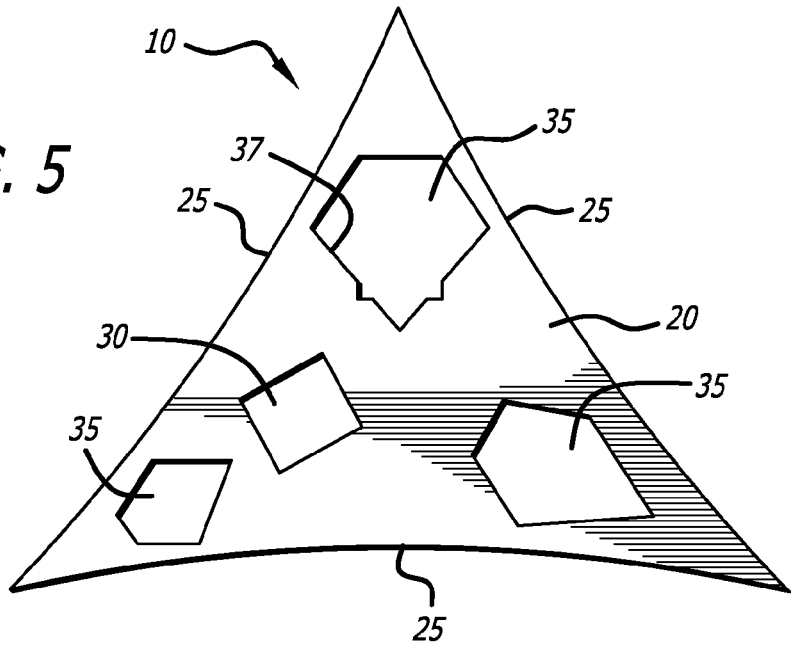
FIG. 5 is a plan view of a preferred embodiment of a triangular device of the present invention.
Figure 6:
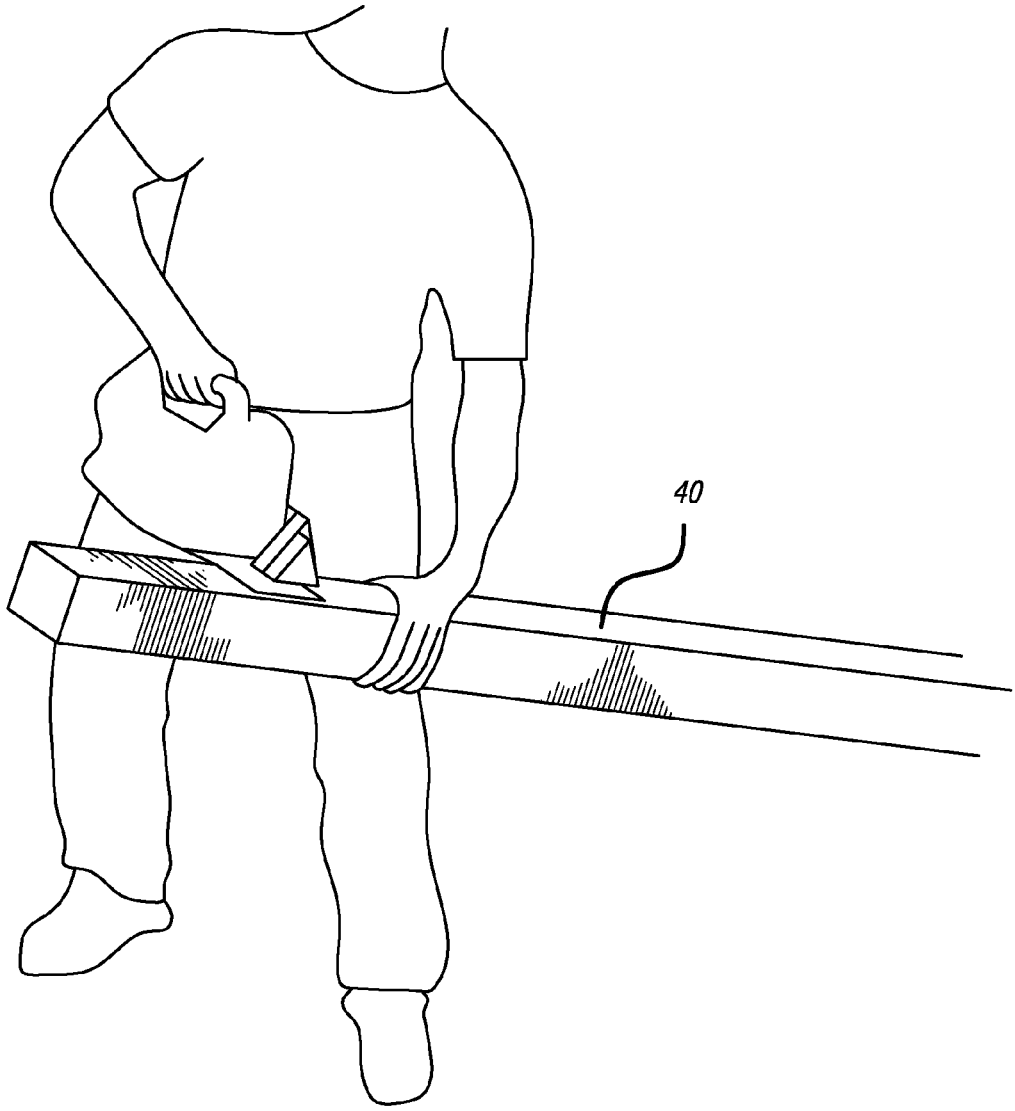
FIG. 6 (Prior Art)
FIG. 6 is a perspective view of a worker using a prior art method that does not properly support and secure an elongated workpiece.

Preferably, in all of the embodiments, any one of the outside edges 25 of the body 20 may be utilized to rest upon the work surface, thereby providing multiple orientations for securing various forms of workpieces 40. As seen in FIGS. 3 and 5, the outside edges 25 may further be adapted for performance on uneven or unstable surfaces. FIG. 3 shows an embodiment of a device 10 having a triangular body 20 with three straight external edges 25 that include protrusions or legs 50 extending therefrom. The legs 50 raise the external edge 25 slightly off the worksurface to accommodate debris or imperfections in the worksurface. FIG. 5 shows an embodiment of a device 10 having a triangular body 20 with three inwardly-curved outside edges 25 that similarly accommodate debris or imperfections in the worksurface.

It is noted that the geometric shapes described above with respect to body 20 are by way of example only. Body 20 may be formed in any shape including a square, rectangle, triangle, circle, oval, non-regular or random shape so long as vise 10 employs some structure e.g. straight or curved external edge 25 or legs 50, that sufficiently supports and stabilizes vise 10 during operation.

Body 20 is preferably made from a strong, rigid material such as aluminum or other metal alloy, composite, plastic, PVC, or other material which allows the user to exert downward force upon workpiece 40 while the workpiece is supported by vise 10. Body 20 may be fabricated relatively thin such that it remains lightweight and portable, enabling the user to easily transfer and use the vise at any worksite. Utilization of a thin profiled body 20 may also improve the wedging or securing action of aperture 30 or irregular aperture 35 upon elongated workpieces 40. Furthermore, a flat body 20 may be advantageous for stacking and packing such as to facilitate shipping and maximize shelf space.

Apertures 30 may be fabricated or cut through body 20 in the form of a square or rectangle which may ideally retain square or rectangular elongated workpieces, as well as similarly shaped materials. Alternatively, or in addition to, irregular shaped apertures 35 may be employed to retain a variety of differently shaped elongated workpieces having circular, square, rectangle or a nonsymmetrical cross sectional shape. For example, in the case of supporting and securing a pipe in vise 10, utilization of a rectangular aperture 30 having a long side positioned parallel to the working surface may result in the pipe moving and spinning within the aperture. A user may benefit from inserting the pipe through an irregular shaped aperture 35 such as, a pentagon, other polygon or parallelogram, as illustrated in FIGS. 2, 3, 5, 7, and 9. Irregular shaped aperture 35 may apply greater wedging or securing action from multiple directions on pipes and other forms of elongated work pieces 40.

Figure 9:
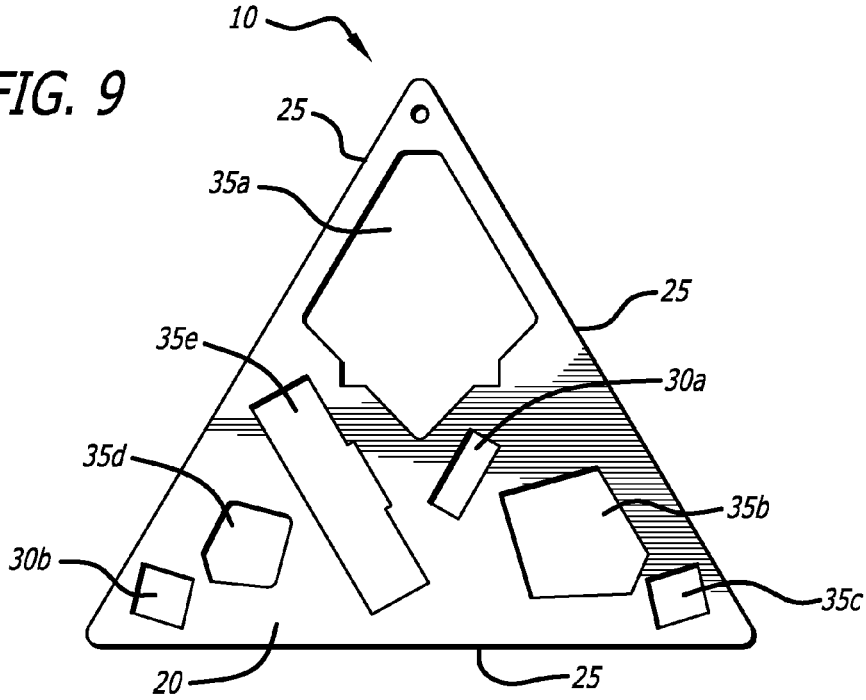

FIG. 9 is an example of a preferred embodiment of the device 10 of the present invention that illustrates the versatility of various apertures 30 and 35. Beginning at the top of the device 10 and working clockwise, aperture 35*a* is sized and shaped to accommodate 3" and 4" pipe and conduit as well as 4"×4" lumber and 4" angle iron and tubing. Aperture 35*b* is sized and shaped to accommodate 2" and 2½" pipe and conduit as well as 2" angle iron and tubing. Aperture 35*c* is sized and shaped to accommodate ½" and ¾" pipe and conduit. Aperture 30*a* is sized and shaped to accommodate 1"×2" lumber and ⅞" unistrut. Aperture 30*b* is sized and shaped to accommodate 1" pipe and conduit. Aperture 35*d* is sized and shaped to accommodate 1¼" and 1½" pipe and conduit. Aperture 35*e* is sized and shaped to accommodate 2"×2", 2"×4" and 2"×6" lumber and 1⅝" unistrut.

In certain embodiments, the location or position of apertures 30 and irregular apertures 35 defined by body 20 may be off-centered towards the outside edges or corners of body 20 or centered with in body 20. FIG. 1 illustrates an embodiment in which apertures are off-centered towards the sides of body 20. FIGS. 2, 3, 5, and 9 illustrate an embodiment in which some apertures are off-centered towards the corners of body 20.

Figure 2:
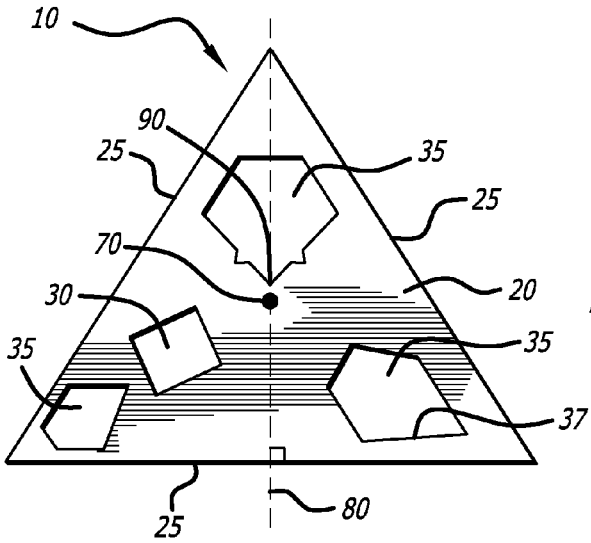
FIG. 2 is a plan view of a preferred embodiment of a triangular device of the present invention.

In certain embodiments of the present invention, such as that illustrated in FIG. 2, the body 20 may contain at least one off-centered aperture 35 that has an apex 90 that points towards the outside edge 25 of the opposite side of body 20. To maximize stability, the aperture 35 may be located such that a line 80 that is perpendicular to the body edge opposite the aperture and passes through the apex 90 passes through or near a center point 70 of the body 20.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A device for supporting a workpiece comprising:

a body having a first face, a second face opposite said first face, and an outside edge;

said body defining a plurality of closed apertures of different shapes and sizes configured to secure elongated workpieces of different cross-sectional shapes and sizes;

said outside edge defining at least one smooth, elongated side configured to reside horizontally on a work surface and support said body;

at least two of said plurality of said dosed apertures positioned substantially above a mid-point of said at least one side configured to reside horizontally on a work surface.

2. The device of dam 1 wherein at least one of said first and second faces is planar.

3. The device of claim 1 wherein said body is triangular.

4. The device of claim 1 wherein said body has a thickness in the range of 2 percent to 6 percent of a length of at least one of a plurality of skies defined by said outside edge.

5. The device of claim 1 wherein said side configured to reside horizontally on a work surface and support said body is planar.

6. The device of claim 1 wherein the body consists of a material selected from the group of materials consisting of: alloy, aluminum, composite, plastic, and PVC.

7. The device of claim 1 wherein at least one of said plurality of apertures is off-center.

8. The device of claim 1 wherein at least one of said plurality of apertures includes an apex that points toward said work surface when said side configured to reside horizontally on a work surface and support said body resides on said work surface.

9. The device of claim 1 wherein each of said plurality of closed apertures is positioned substantially above a mid-point of said at least one side configured to reside horizontally on a work surface and support said body.

10. The device of claim 1 wherein each of said plurality of closed apertures has a planar interior surface.

11. A method for securing an end portion of an elongated workpiece above a surface comprising:

selecting a closed aperture from a plurality of closed apertures of different shapes and sizes defined by a planar body based on a cross-sectional size and shape of said workpiece;

placing an end portion of said elongated workpiece through said selected closed aperture;

resting a smooth, elongated supporting side of said body on said surface;

tilting said planar body such that an upward force is placed on a bottom portion of said elongated workpiece by at least one supporting inside surface of said aperture and a downward force is placed on a top portion of said elongated workpiece by at least one counteracting inside surface of said aperture.

12. The method of claim 11 wherein said step of selecting a closed aperture from a plurality of dosed apertures of different shapes and sizes defined by a planar body based on a cross-sectional size and shape of said workpiece comprises maximizing a distance between the surface and the workpiece.

13. The method of claim 11 wherein said step of selecting a closed aperture from a plurality of dosed apertures of different shapes and sizes defined by a planar body based on a cross-sectional size and shape of said workpiece comprises selecting an aperture having a downward-pointing apex based on a circular cross-sectional shape of said workpiece.

14. The method of claim 11 wherein said step of resting a smooth, elongated supporting side of said body on said surface comprises resting a planar side of said body on said surface.

15. A device for securing an end portion of an elongated workpiece above a work surface comprising:

a planar body having an outside edge defining at least three smooth, elongated sides, one of said at least three smooth, elongated sides configured to reside on a work surface when said planar body is securing an end portion of an elongated workpiece;

said planar body defining a plurality of apertures of different shapes and sizes configured to secure elongated workpieces of different cross-sectional shapes and sizes;

each of said plurality of apertures positioned substantially above a mid-point of said one of said at least three smooth; elongated sides configured to reside on a work surface.

16. The device of claim 15 wherein said body has a thickness in the range of 2 percent to 6 percent of a length of one of said at least three smooth, elongated sides.

17. The device of claim 15 wherein said body is triangular.

18. The device of claim 15 wherein at least one of said plurality of apertures includes an apex that points toward said work surface when said planar body is securing an end portion of an elongated workpiece.

19. The device of claim 15 wherein said plurality of apertures comprises at least one aperture having a side that is parallel to an opposite side of said body.

20. The device of claim 15 wherein said one of said at least three smooth, elongated sides configured to reside on a work surface is planar.

21. The device of claim 15 wherein each of said plurality of apertures has a planar interior surface.

* * * * *